US006619099B2

(12) United States Patent
Barjesteh

(10) Patent No.: US 6,619,099 B2
(45) Date of Patent: Sep. 16, 2003

(54) HYDRAULICALLY POWERED FLARING HAND TOOL

(75) Inventor: Michael Barjesteh, Denville, NJ (US)

(73) Assignee: Mastercool, Inc., Randolph, NJ (US)

( * ) Notice: Subject to any disclaimer, the term of this patent is extended or adjusted under 35 U.S.C. 154(b) by 60 days.

(21) Appl. No.: 09/978,518

(22) Filed: Oct. 16, 2001

(65) Prior Publication Data

US 2002/0043093 A1 Apr. 18, 2002

Related U.S. Application Data

(60) Provisional application No. 60/240,749, filed on Oct. 16, 2000.

(51) Int. Cl.[7] ..... B21D 39/20

(52) U.S. Cl. ..... 72/393; 72/453.16

(58) Field of Search ..... 72/393, 453.15, 72/453.16

(56) References Cited

U.S. PATENT DOCUMENTS

| | | | |
|---|---|---|---|
| 943,117 | A | 12/1909 | Lucas et al. |
| 3,888,102 | A | 6/1975 | Nigido |
| 4,068,515 | A | 1/1978 | Kowal et al. |
| 4,144,735 | A | 3/1979 | Rothenberger |
| 4,198,844 | A | 4/1980 | Lowe et al. |
| 4,308,736 | A | 1/1982 | Lowe et al. |
| 4,779,441 | A | 10/1988 | Pringle |
| 5,782,128 | A | 7/1998 | Barjesteh et al. |
| 5,956,987 | A | 9/1999 | Anthoine |

FOREIGN PATENT DOCUMENTS

| | | | |
|---|---|---|---|
| EP | 0722794 | A1 | 7/1996 |

*Primary Examiner*—Lowell A. Larson
(74) *Attorney, Agent, or Firm*—Mathews, Collins, Shepherd & McKay

(57) ABSTRACT

The movement of an expander by actuation of a manual hydraulic pump in a hydraulically powered flaring hand tool contacts die elements so as to move the die elements radially outward to flare hollow malleable cylindrical tubing. The tool has a manual hydraulic pump for producing movement of a shaft, an adjuster member coupled to the manual hydraulic pump, permitting the shaft to slide through the adjuster member, an expander coupled to the shaft end, and a die set having a plurality of die elements, the die set is coupled to the adjuster member.

20 Claims, 3 Drawing Sheets

HYDRAULICALLY POWERED FLARING HAND TOOL

This application claims benefit of Provisional Application Ser. No. 60/240,749 filed Oct. 16, 2000.

FIELD OF INVENTION

The present invention relates to manually operable, portable, hydraulically powered, flaring hand tools.

BACKGROUND OF THE INVENTION

Conventional fittings, adapters or couplers have been used for connecting malleable cylindrical conduit to a tube, a hose, a fitting or another conduit. One of the methods of connection involves flaring the tube. There are many approaches to flaring a tube that relate to plastically deforming the end of the tube or end region. Conventional flaring apparatus, wherein a flaring cone is urged into the distal end of the tube, are illustrated by U.S. Pat. No. 4,068,515 issued to Kowal, et al. on Jan. 17, 1978 entitled Flaring Tool and U.S. Pat. No. 4,779,441 issued to Pringle on Oct. 25, 1988 entitled Tube Having A Flared End. In general, these and similar patents are related to an apparatus for forming a flare of different shapes and forms on an end of a hollow malleable cylindrical conduit. The shape of the flared end is contoured accurately to conform to the seating surface of the fitting to which the flared tube is to be connected.

In many other applications, such as connecting a conduit to another conduit of the same diameter, it is desirable to have a radially outward expansion on the end of the tube. When soldered or brazed, this type of connection will seal the fluid inside the tube.

Therefore, there is a need to provide a portable hand tool that creates a controlled expansion in end section of a tube.

SUMMARY OF THE INVENTION

The movement of an expander by actuation of a manual hydraulic pump in a hydraulically powered flaring hand tool contacts die elements so as to move the die elements radially outward to flare hollow malleable cylindrical tubing. The tool has a manual hydraulic pump for producing movement of a shaft, an adjuster member coupled to the manual hydraulic pump, permitting the shaft to slide through the adjuster member, an expander coupled to the shaft end, and a die set having a plurality of die elements, the die set is coupled to the adjuster member.

BRIEF DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

There exists a need for a versatile hand tool that can be used as a repair tool for tubes (conduits) that are attached to, or part of, a larger machine or system. The present invention is to a portable hand tool for creating an expansion outward on the end of the tube. The tool can be used as a repair apparatus for connecting a fluid line to a different conduit. The present invention is a manually operable hand tool, which provides a particular radially outward expansion flare, on a deformable tube. The present invention comprises an adjustable portion having internal threads, which can move axially on a threaded positioning screw that is fixed to a manual hydraulic pump portion by two setscrews. Rotation of the portion relative to the pump embodiment brings the two units axially closer or farther apart relative to one another. The adjustable portion attaches to the die portion moving the die portion along with the adjustable portion. The pump portion comprises a cylindrical body, a flaring piston, a threaded positioning screw and a pumping unit. The cylindrical body has an oil reservoir located in the rear end of the body and a pressurized cylinder located in the front of the body. The positioning screw is a long hollow cylinder having threads on its outer surface and is rigidly connected to the cylindrical body. A flaring piston is located in the pressurized cylinder; it has an axially elongated body that extends through the positioning screw. The pumping unit comprises a lever arm, a linkage set, a spring and a piston which forces the fluid to flow from the oil reservoir to the pressurized front chamber of the cylinder. The pumping unit also has a relief valve unit that allows the fluid to return to the reservoir, thereby returning the piston to its initial position. A guide is placed at the end of the flaring piston that has an opening side into which the expander is placed and is secure relative to the piston in and out motion. In a first embodiment the proper size expander die is placed inside the tube: The assembled unit is "pumped" causing the expander to enter the expander die causing die inserts to move outward and form a expanded section on tube end. The hand tool structure of the present invention is extremely simple and could be used in any location, including on site repair of fluid lines, without detaching the tube from its connection to field equipment, which gives an economical advantage to this invention.

Figure 1:
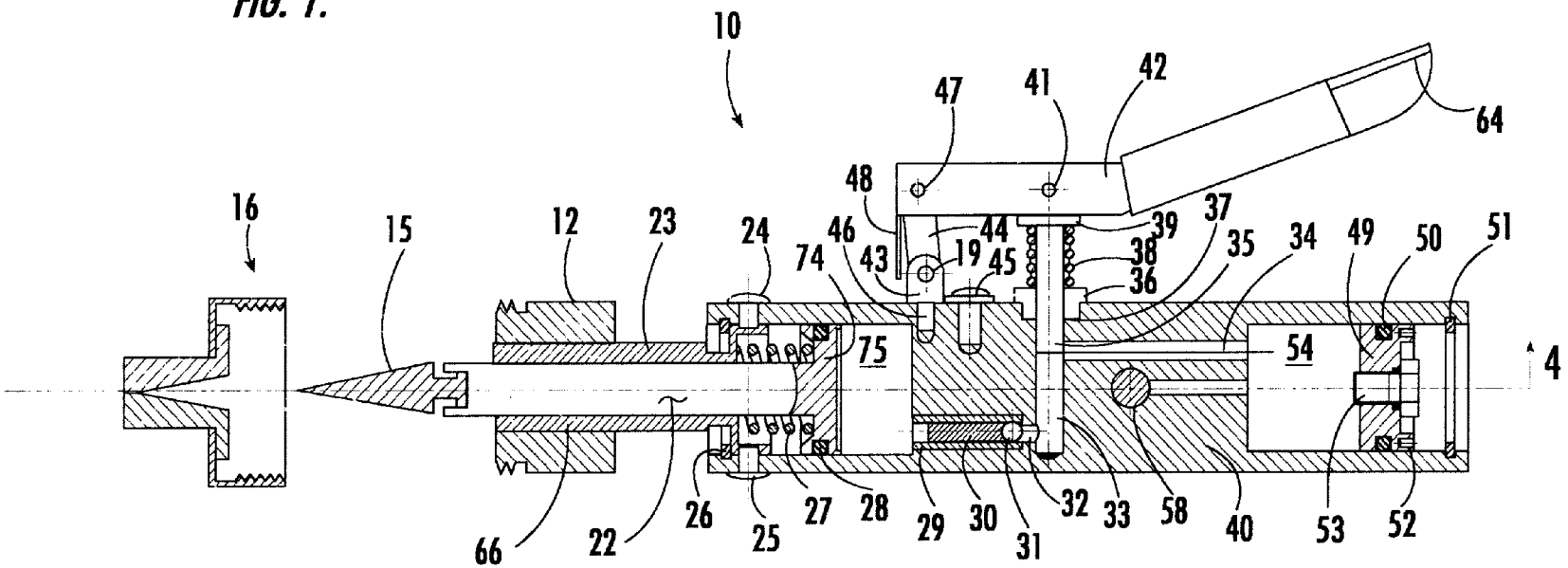
FIG. 1 is a cross sectional view of the hand tool expansion flaring apparatus illustrating the pressure relief valve operation, in a closed valve position.

Referring now to the drawings the exemplary embodiment of the invention as disclosed in FIG. 1 illustrates the hand tool expansion flaring apparatus 10 in accordance with the teachings of the present invention. The present invention, hydraulically powered flaring hand tool, 10 has generally an adjustable portion 12 and a hydraulic pump portion 40. Hydraulic pump embodiment 40 consists of positioning screw 23 that is a cylindrical tube having its outer surface threaded. Positioning screw 23 is fixed to the body of 40 by two setscrews 24 and 25, and is secured axially by snap ring 26. Flaring piston 22 is a solid cylindrical rod having circular notch 98 at its distal end and piston member 74 that is a larger diameter disc at the other end. Circular disk 74 has O-ring 28 and is placed in frontal pressurized cylinder 75. Spring 27 applies a bias compression force to flaring piston 22 and a disk 74 that is partially counteracting the oil pressure in the pressurized cylinder region 75. Hydraulic pump 40 also has cylindrical passages 32, 33 and 34 that connect oil reservoir 54 to frontal pressurized cylinder 75. Spring 30 compresses the spherical ball 31 against the opening of passage 32. The diameter of the opening passage 32 is smaller than the diameter of ball 31 thus the compressive force of spring 30 keeps ball 30 at the opening of passage 32 thereby closing the opening. Set screw 29 adjusts the compressive load of spring 30, set screw 29 can be rotated clockwise using a screw driver as shown in FIG. 1. Hydraulic pump 40 has a pumping linkage system consisting of piston 35, lever arm 42, linkage bar 44 and support bracket. 43. The oil is pumped from the reservoir 54 to 75 by piston 35 and lever arm 42. Piston 35 is secured in passage 33 by cap screw 36 and is sealed by O-ring 37. Spring 38 applies an upwardly compressive force to lever arm 42 through washer 39. The compressive force of spring 38 keeps lever arm 42 and hydraulic pump 40 separated and connects passages 34 and 33 by moving piston 35 upwardly. Lever arm 42 is hinged to linkage bar 44 by pin 47. Linkage bar 44 is hinged to support bracket 43 by pin 19. Support bracket 43 is rigidly attached to hydraulic pump 40 by screws 45 and 46, thus the whole pumping linkage system is stabilized. Stopper bar 48 that is attached to lever arm 42 limits the separation of lever arm 42 and hydraulic body 40. As further illustrated in FIG. 1 oil reservoir 54 is located in the rear embodiment of hydraulic pump 40 and is closed by reservoir piston 49. O-ring 50 prevents oil leakage from the reservoir while snap ring 51 limits and restrains axially rearward movement of reservoir piston 49. To add or drain the oil in reservoir 54 screw 53 is provided. Reservoir piston 49 has two holes 52. To open or close screw 53 for adding or draining the oil, two holes 52 are used to prevent reservoir piston 49 from rotation.

Again referring to FIG. 1, in a free position of lever arm 42, spring 38 applies compressive force to washer 39 and pushes lever arm 42 away from hydraulic pump 40. The compressive force 39 and pushes lever arm 42 away from hydraulic pump 40. The compressive force is counteracted by the contacts that stopper 48 makes with support bracket 43. This is an upper limit position of lever arm 42. In this case, piston 35 is in its most upwardly position thereby connecting oil passages 33 and 34 to oil reservoir 54. By pressing lever arm 42 downward towards hydraulic pump 40, spring 38 is compressed, piston 35 is pushed downward through cylindrical passage 33, thereby pressurizing the oil that is in passages 33 and 32. The pressure in passage 32 pushes spherical ball 31 away from the opening of passage 32, thus forcing the oil to flow to frontal piston region 75. Once the oil has pressurized cylinder 75, spring 30 applies the bias force to ball 31 and closes the opening of passage 32 and thus prevents the reverse flow of the oil from region 75 to reservoir 54. Therefore, after a few strokes of lever arm 42, region 75 is pressurized and through disk 74, flaring piston 22 applies an axially compressive force to expander 15 causing die set 16 to expand.

Figure 2:
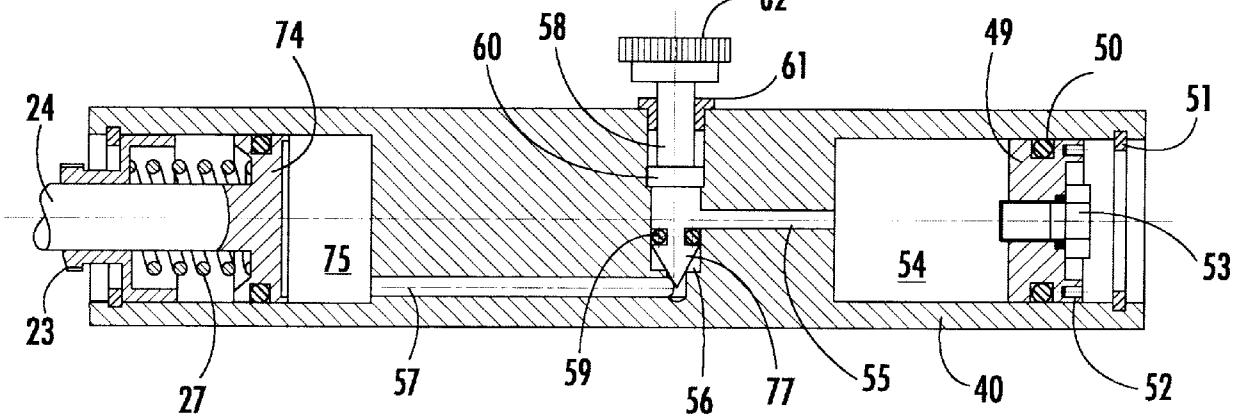
FIG. 2 is a fragmentary section view of the hand tool apparatus as shown in FIG. 1, illustrating the pressure relief valve operation, in a closed valve position.
Figure 3:
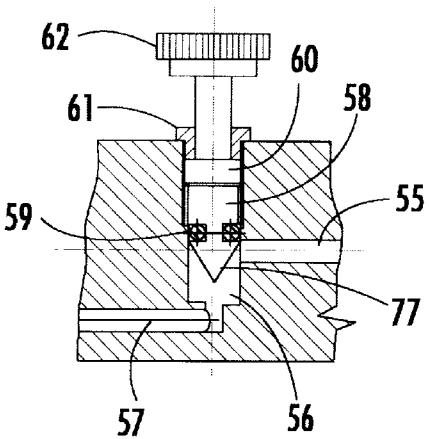
FIG. 3 is a fragmentary section view of the hand tool apparatus as shown in FIG. 1, illustrating the open valve position.

Still referring to FIG. 1, once the expanding process is completed the flared tube is retrieved by expanding pressure in region 75 through a relief valve. The pressure region 75 is released when valve nub 62 is turned counter clockwise. Oil reservoir 54 is also connected to the region 75 through separate return passages 57, 56, and 55 that are located in a plane perpendicular to the plane of intake passages 32, 33 and 34. The pressure relieve valve unit consists of knob 62, valve stem 58, O-ring 59 and cap screw 61. Valve stem 58 has thread 60 in its mid section. Cylindrical passage 56 has internal thread 78. Valve stem 58 is screwed into threads 78 of passage 56. Cap screw 61 guides valve stem 58 in the axial movement and prevents the stem from being unscrewed out of passage 59. To close the valve, nub 62 is turned clockwise thereby bringing stem 58 down into passage 56. The fully closed valve position is shown in FIG. 2 wherein conical tip 77 of valve stem 58 is seated on the 58 is seated circular opening of the passage 57. In this position, oil can only flow from reservoir 54 to 75 through one-way passages 32, 33 and 34. To open the valve, nub 62 is turned counter clockwise thereby bringing stem 58 upwardly out of the opening of passage 56. The open position of the valve is shown FIG. 3 were conical tip 77 is separated from the circular opening of passage 57, thus connecting passages 57, 56 and 55. In the open position the oil pressure of 75 is released by directing the oil back to reservoir 54 through passages 57, 56 and 55.

As shown in FIG. 1, adjuster 12 has internally threaded portion 66 that engages with the positioning screw 23. Expander die 16 is a crucial element in the flaring process since it dimensions varies for different sizes tube. The frontal end of adapter die has a cylindrical hole into which expander goes. The rear end of the die set 16 threads on to the adjuster 12.

To pump the oil lever arm 42 is pressed down towards pump 40 repeatedly which hydraulically energizes flaring piston 22 and deforms tube into an expanded outwards position. To retrieve the deformed tube, the oil pressure is released by opening the relief valve 62 that is turning nub 62 counter clockwise.

Figure 4B:
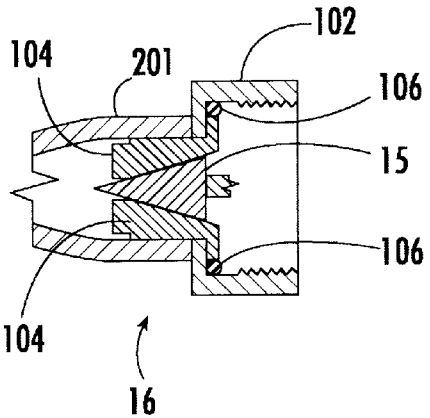
FIG. 4*b* is a cross sectional view of the die set and expander in the expanded position; and, FIG. 5 is a detailed cross sectional view of the another expander embodiment.
Figure 4A:
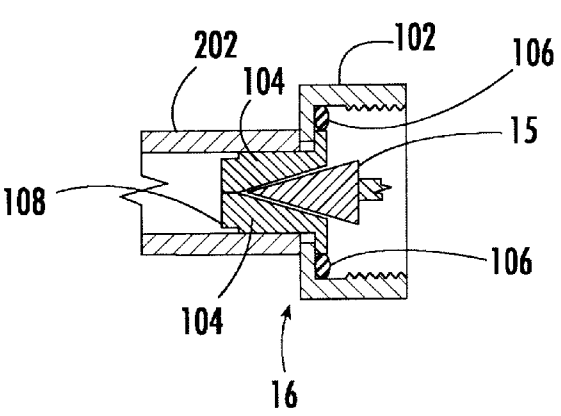
FIG. 4*a* is a cross sectional view of the die set and expander in the unexpanded position.

Referring to FIG. 4*a* in conjunction with FIG. 4*b* there is shown a detail of the die set 16 and expander 15. The die set 16 is comprised of a threaded die holder 102 and a plurality of die elements 104. In one embodiment the plurality of dies consist of six die elements 104. Although other numbers of elements may be used, two few can result in the tubing being strained resulting in weakness of the flared end and possible tearing or other failure. The die elements 104 are held in the unexpanded position by a spring element 106 or a deformable resilient material.

With the die elements in the unexpanded position, shown in FIG. 4*a* the die elements 104 are slid inside the tubing 202. One feature of the present invention is that with the hand tool expansion flaring apparatus 10 there is no need to secure or clamp the tubing 202. Clamping or holding of the tubing 202 can result in damage such as scratching of the exterior, which can compromise the subsequent seal of the tubing 202 as well as cause a weakness at the flared end. As the hydraulic pump 40 (not shown in this figure) is actuated, the expander 15 slides into the die set 16. After the expander 15 makes contact with the die elements 104, the die elements 104 move radially outward. Initially, the movement results in the die elements 104 holding the tubing 202 in place. Further movement of the expander 15 results in the tubing 202 being flared by the radially outward force applied by the die elements 104 on the deformable tubing 202. The maximum amount of flaring is limited by the die holder 102 which limits the outward radial movement of the die elements 104. Upon completion of the flaring of the deformable tubing 202, release of the hydraulic pressure created by the hydraulic pump 40 permits the die elements 104 to return to their unexpanded position, thus providing for one handed set up, operation and removal.

Figure 5:
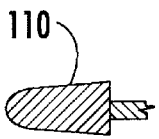

Referring to FIGS. 4*a* and 4*b* again there are shown detailed cross sectional views of the die elements and the expander. In yet another embodiment of the present invention, the die elements 104 have a small indentation 108. This indentation 108 enables the unexpanded die elements 104 to be inserted into a deformable tubing 202 which has been cut and thus has a burred end, without the necessity of reaming the tubing 202, which will produce metal filings and slivers that may contaminate the interior area of the tubing 202. By using an expander 110, shown in FIG. 5 with a geometry that differs slightly from the interior geometry of the die elements 104, the shape of the flaring of the deformable tubing 202 may be altered in addition to controlling the shape of the flaring by the shape of the die elements 104, as the die elements 104 can pivot slightly, producing a wider flare in the deformable tubing 202 than at the end of the tubing 202.

Numerous modifications and alternative embodiments of the invention will be apparent to those skilled in the art in view of the foregoing description. The die elements and the expander may utilize a number of different geometrical configurations. Accordingly, this description is to be construed as illustrative only and is for the purpose of teaching those skilled in the art the best mode of carrying out the invention. Details of the structure may be varied substantially without departing from the spirit of the invention and the exclusive use of all modifications, which come within the scope of the appended claims, is reserved.

What is claimed:

1. A hydraulically powered flaring hand tool for flaring of a hollow malleable cylindrical tubing comprising:

a manual hydraulic pump for producing movement of a shaft;

an adjuster member coupled to the manual hydraulic pump, permitting the shaft to slide through the adjuster member;

an expander having a round conical shape coupled to the shaft end;

a die set having a plurality of die elements, the die set coupled to the adjuster member;

wherein movement of the expander by actuation of the manual hydraulic pump contacts the die elements so as to move the die elements radially outward to flare the hollow malleable cylindrical tubing, the axial movement of the expander is controlled by positioning the adjuster member whereby over expansion and excessive stress to the die set is prevented.

2. The hydraulically powered flaring hand tool as recited in claim 1 wherein the expander is loosely coupled to the shaft end.

3. The hydraulically powered flaring hand tool as recited in claim 1 wherein the shape of the expander corresponds to the interior shape of the die elements.

4. The hydraulically powered flaring hand tool as recited in claim 1 wherein the plurality of die elements is comprised of at least six die elements.

5. The hydraulically powered flaring hand tool as recited in claim 1 wherein the shape of the expander corresponds to a shape so that the plurality of die elements produce a wider flare in the hollow malleable cylindrical tubing than at the end of the hollow malleable cylindrical tubing.

6. The hydraulically powered flaring hand tool as recited in claim 1 wherein the die elements are held in an unexpanded position when the die elements are not in contact with the expander.

7. The hydraulically powered flaring hand tool as recited in claim 6 wherein the die elements are held in the unexpanded position by a spring.

8. The hydraulically powered flaring hand tool as recited in claim 6 wherein the die elements are held in the unexpanded position by a resilient material.

9. The hydraulically powered flaring hand tool as recited in claim 1 wherein the die elements have at notch.

10. The hydraulically powered flaring hand tool as recite in claim 1 wherein the tool can be operated with a single hand.

11. The hydraulically powered flaring hand tool as recited in claim 1 wherein the die set size varies as a function of an outer diameter and wall thickness of the hollow malleable cylindrical tubing.

12. The hydraulically powered flaring tool as recited in claim 1 wherein the maximum radial movement of the plurality of die elements is limited.

13. A hydraulically powered flaring hand tool kit for flaring of a hollow malleable cylindrical tubing comprising:

a manual hydraulic pump for producing movement of a shaft;

an adjuster member coupled to the manual hydraulic pump, permitting the shaft to slide through the adjuster member;

a round conical shaped expander coupled to the shaft end;

a plurality of die sets each having a plurality of die elements, the die set coupled to the adjuster member;

wherein movement of the expander by actuation of the manual hydraulic pump contacts the die elements so as to move the die elements radially outward to flare the hollow malleable cylindrical tubing and the die set size varies as a function of an outer diameter and wall thickness of the hollow malleable cylindrical tubing, the axial movement of the expander is controlled by positioning the adjuster member whereby over expansion and excessive stress to the die set is prevented.

14. The hydraulically powered flaring hand tool kit as recited in claim 13 wherein the shape of the expander corresponds to the interior shape of the die elements.

15. The hydraulically powered flaring hand tool kit as recited in claim 13 wherein the plurality of die elements is comprised of at least six die elements.

16. The hydraulically powered flaring hand tool kit as recited in claim 13 wherein the die elements are held in an unexpanded position when the die elements are not in contact with the expander.

17. The hydraulically powered flaring hand tool kit as recited in claim 16 wherein the die elements are held in the unexpanded position by a spring.

18. The hydraulically powered flaring hand tool kit as recited in claim 16 wherein the die elements are held in the unexpanded position by a resilient material.

19. The hydraulically powered flaring hand tool kit as recited in claim 13 wherein the die elements have at notch.

20. The hydraulically powered flaring hand tool kit as recite in claim 13 wherein the tool can be operated with a single hand.

* * * * *